US009550281B2

(12) United States Patent
Cheng

(10) Patent No.: US 9,550,281 B2
(45) Date of Patent: Jan. 24, 2017

(54) PNEUMATIC TOOL

(71) Applicant: Ming-Ta Cheng, Taichung (TW)

(72) Inventor: Ming-Ta Cheng, Taichung (TW)

( * ) Notice: Subject to any disclaimer, the term of this patent is extended or adjusted under 35 U.S.C. 154(b) by 662 days.

(21) Appl. No.: 14/028,589

(22) Filed: Sep. 17, 2013

(65) Prior Publication Data

US 2015/0075832 A1 Mar. 19, 2015

(51) Int. Cl.
*B25F 5/00* (2006.01)
*B25B 21/00* (2006.01)
*B25F 5/02* (2006.01)

(52) U.S. Cl.
CPC *B25B 21/00* (2013.01); *B25F 5/02* (2013.01)

(58) Field of Classification Search
CPC ..... B25B 21/00; B25F 5/001; B25F 5/02
USPC ..... 137/269, 270; 173/269, 270
See application file for complete search history.

(56) References Cited

U.S. PATENT DOCUMENTS 7,174,971 B1 * 2/2007 Chen ..... B25B 21/00 173/104
2003/0132306 A1 * 7/2003 Chiu ..... E03C 1/04 239/25
2004/0055769 A1 * 3/2004 Chou ..... B25B 21/00 173/216
2007/0011884 A1 * 1/2007 Hua ..... B25B 21/00 30/276
2010/0031780 A1 * 2/2010 Lu ..... B25B 21/00 81/54
2010/0305624 A1 * 12/2010 Lozier ..... A61B 17/068 606/86 R
2012/0037826 A1 * 2/2012 McCoy ..... F16K 5/0442 251/304
2013/0075123 A1 * 3/2013 Sun ..... B25F 5/00 173/221
2013/0186665 A1 * 7/2013 Hua ..... B25F 5/00 173/170
2013/0255982 A1 * 10/2013 Takahashi ..... B25F 5/001 173/47

* cited by examiner

*Primary Examiner* — Michelle Lopez
*Assistant Examiner* — Chinyere Rushing-Tucker
(74) *Attorney, Agent, or Firm* — Alan D. Kamrath; Kamrath IP Lawfirm, P.A.

(57) ABSTRACT

A pneumatic tool has an outer casing, a selector valve, a switching button and a cover. The outer casing has two elongated holes formed through an external surface of the outer casing, and facing and communicating to each other. The selector valve is rotatably mounted in the outer casing and has a communicating hole and two connecting blocks. The connecting blocks are axially formed on and protrude from an external surface of the selector valve, align with each other and respectively face the elongated holes. The switching button is detachably connected to one of the connecting blocks and extends out of one of the elongated holes. The cover is detachably connected to the outer casing to cover the other elongated hole and has a shape corresponding to a shape of the external surface of the outer casing.

8 Claims, 6 Drawing Sheets

PNEUMATIC TOOL

BACKGROUND OF THE INVENTION

1. Field of the Invention

The present invention relates to a pneumatic tool and, more particularly, to a pneumatic tool that can be operated and adjusted conveniently.

2. Description of Related Art

In general, conventional pneumatic tools are used to fasten or loosen bolts or nuts by driving and controlling the flow direction of compressed air in the conventional pneumatic tools.

With reference to FIG. 5, a conventional pneumatic tool 70 has an outer casing 71, a cylinder, a selector valve and a switching button 60. The outer casing 71 has a rear end, an external surface and two elongated holes 711. The elongated holes 711 are formed through the external surface of the outer casing 71 at an interval near the rear end of the outer casing 71. The cylinder is mounted in the outer casing 71. The selector valve is rotatably and adjustably mounted in the outer casing 71 and selectively communicates with the cylinder.

The switching button 60 is movably mounted in the outer casing 71, is connected to the selector valve and has two pressing tabs 61. The pressing tabs 61 respectively extend out of the elongated holes 711 of the outer casing 71. Then, the conventional pneumatic tool 70 can control the flow direction of the compressed air by pushing the pressing tabs 61 of the switching button 60 to rotate the selector valve relative to the cylinder.

However, the switching button 60 of the conventional pneumatic tool 70 can be used to control the flow direction of the compressed air. With reference to FIG. 6, in use, one of the user's hands (either right hand or left hand) holds the outer casing 71 of the pneumatic tool 70. When the user wants to fasten or loosen a bolt or a nut, one of the pressing tabs 61 of the switching button 60 is pushed to move relative to the outer casing 71 by the user's thumb, and the other pressing tab 61 will be moved with the switching button 60 in a reverse direction. Therefore, when the user's thumb pushes the corresponding pressing tab 61 to move upwardly relative to the outer casing 71, the other pressing tab 61 will be moved downwardly relative to the outer casing 71 and may hit the other fingers of the user's hand, and this is inconvenient in use.

To overcome the shortcomings, the present invention provides a pneumatic tool to mitigate or obviate the aforementioned problems.

SUMMARY OF THE INVENTION

The main objective of the present invention is to provide a pneumatic tool that can be operated and adjusted conveniently.

The pneumatic tool in accordance with the present invention has an outer casing, a selector valve, a switching button and a cover. The outer casing has two elongated holes formed through an external surface of the outer casing, and facing and communicating to each other. The selector valve is rotatably mounted in the outer casing and has a communicating hole and two connecting blocks. The connecting blocks are axially formed on and protrude from an external surface of the selector valve, align with each other and respectively face the elongated holes. The switching button is detachably connected to one of the connecting blocks and extends out of one of the elongated holes. The cover is detachably connected to the outer casing to cover the other elongated hole and has a shape corresponding to a shape of the external surface of the outer casing.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
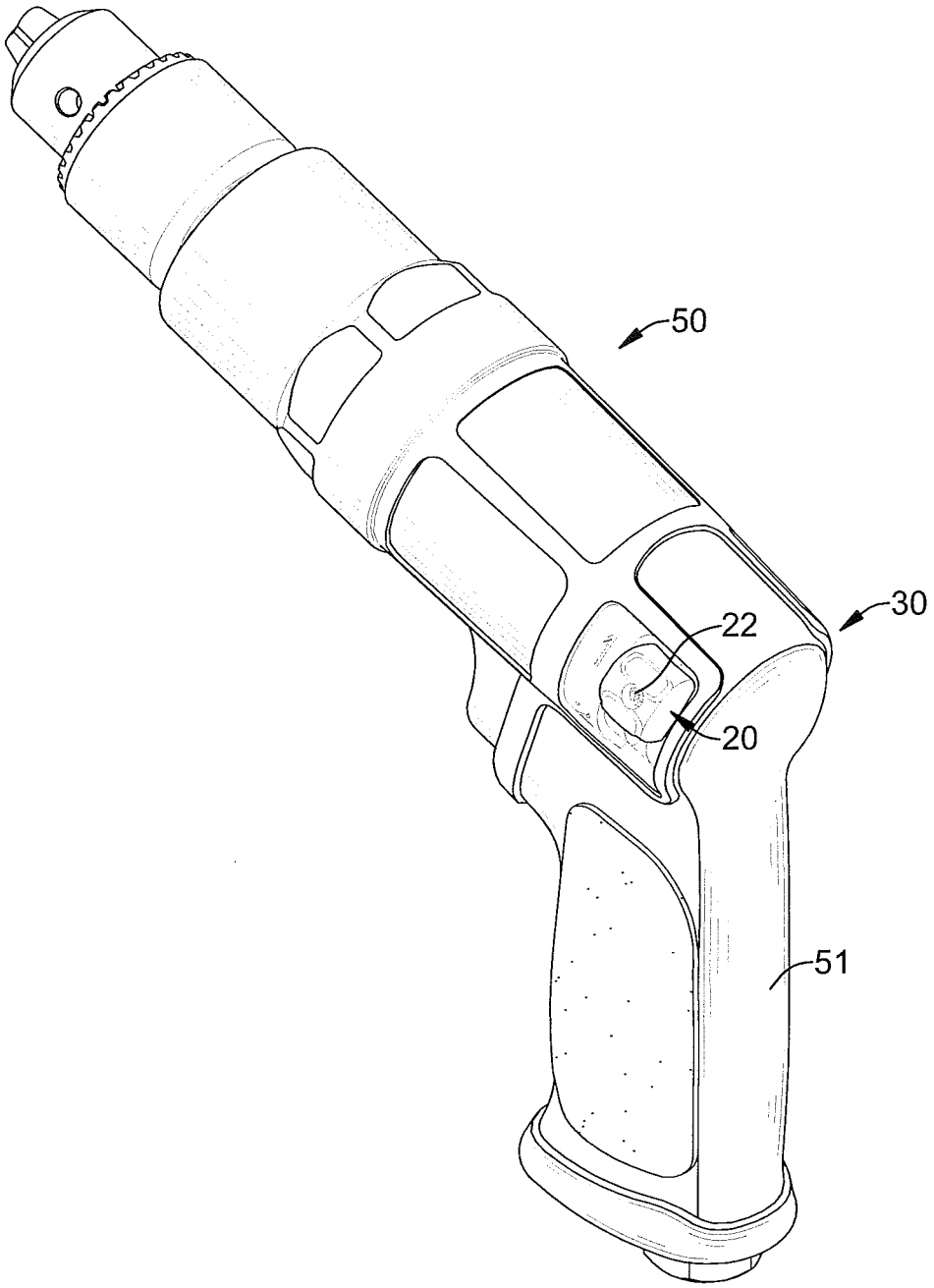
FIG. 1 is a perspective view of a pneumatic tool in accordance with the present invention.
Figure 2:
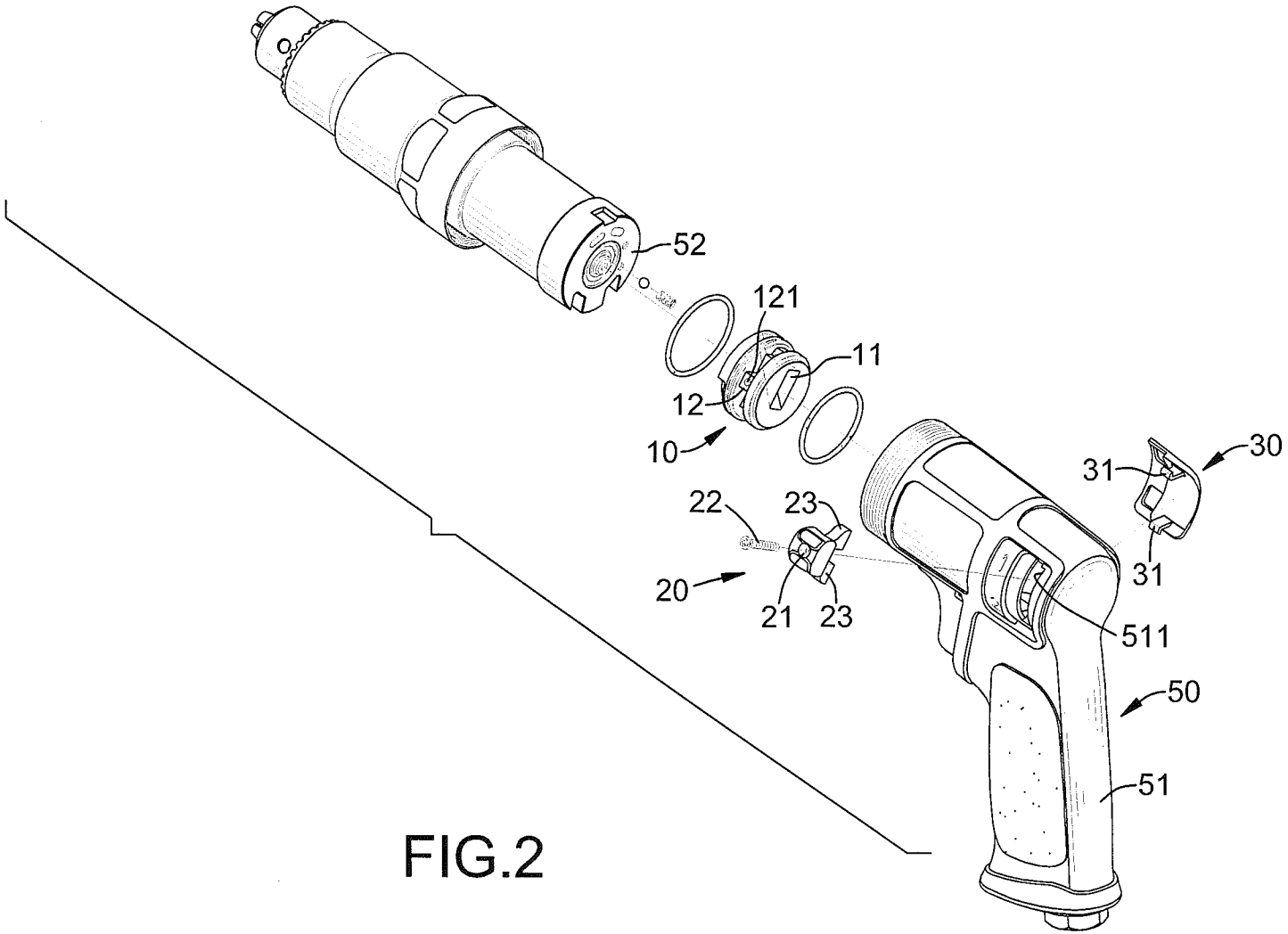
FIG. 2 is an exploded perspective view of the pneumatic tool in FIG. 1.
Figure 3:
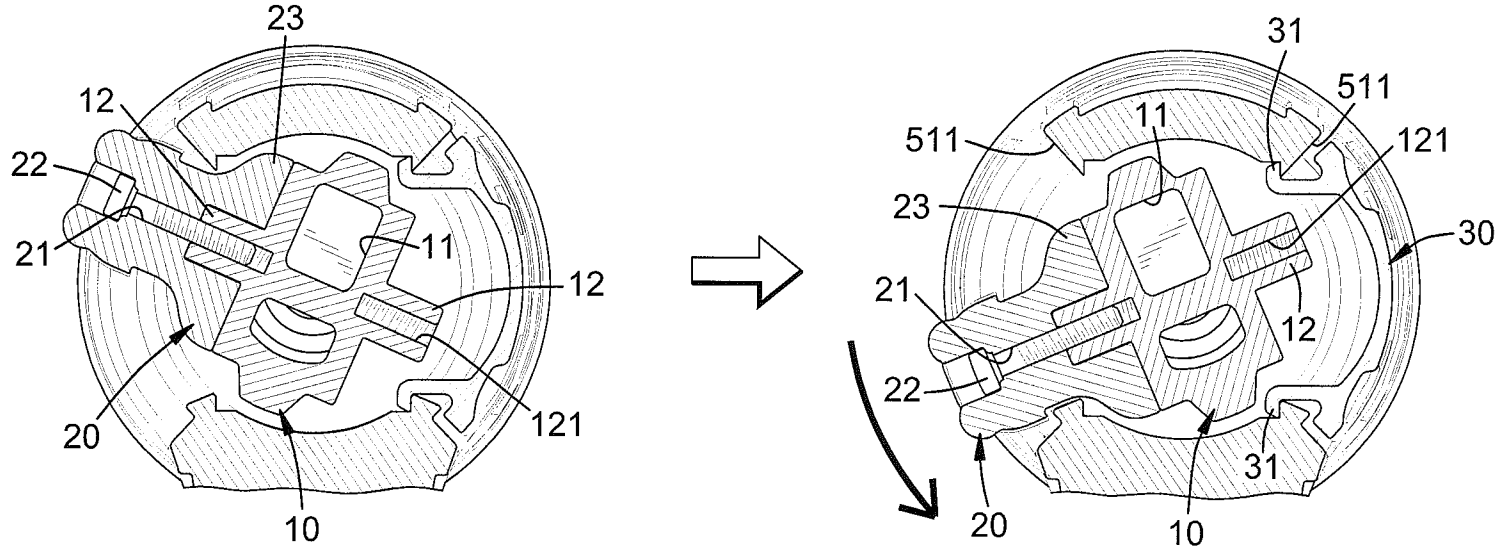
FIG. 3 is an operational side view in partial section of the pneumatic tool in FIG. 1.

With reference to FIGS. 1 to 3, a pneumatic tool 50 in accordance with the present invention comprises an outer casing 51, a selector valve 10, a switching button 20 and a cover 30.

The outer casing 51 has a rear end, an external surface, a cylinder 52 and two elongated holes 511. The cylinder 52 is mounted in the outer casing 51 and has a forward passageway and a reverse passageway. The elongated holes 511 are formed through the external surface of the outer casing 51 near the rear end of the outer casing 51 adjacent to the cylinder 52, and face and communicate to each other.

The selector valve 10 is rotatably mounted in the outer casing 51 behind the cylinder 52 and has a rear side, a middle segment, an external surface, a communicating hole 11 and two connecting blocks 12. The communicating hole 11 is obliquely formed through the rear side of the selector valve 10 and selectively communicates with the forward passageway and the reverse passageway of the cylinder 52. The connecting blocks 12 are axially formed on and protrude from the external surface of the selector valve 10 at the middle segment, align with each other and respectively face the elongated holes 511 of the outer casing 51. Each one of the connecting blocks 12 has a center, an external surface and a connecting hole 121. The connecting hole 121 is formed in the center of the connecting block 12 and may be a threaded hole.

The switching button 20 is detachably connected to one of the connecting blocks 12 of the selector valve 10, extends out of one of the elongated holes 511 of the outer casing 51 and has an inner side, an outer side, a through hole 21, a fixing element 22 and two limiting blocks 23. The inner side of the switching button 20 is mounted in the outer casing 51 via the corresponding elongated hole 511 and abuts with the corresponding connecting block 12. The outer side of the switching button 20 extends out of the external surface of the outer casing 51 via the corresponding elongated hole 511.

The through hole 21 is formed through the inner side and the outer side of the switching button 20 and aligns with the connecting hole 121 of the corresponding block 12. The fixing element 22 is mounted through the through hole 21 from the outer side to the inner side of the switching button 20 and is securely connected to the connecting hole 121 of the corresponding connecting block 12 to enable the switching button 20 to connect with the selector valve 10 at the external surface of the outer casing 51. The limiting blocks 23 are formed on and protrude from the inner side of the switching button 20 at an interval and abut with the external surface of the corresponding connecting block 12 to enable the switching button 20 to steady connect with the selector valve 10.

The cover 30 is detachably connected to the outer casing 51 to cover the other elongated hole 511 that is opposite to the switching button 20 and has a shape, an inner side and two engaging hooks 31. The shape of the cover 30 corresponds to a shape of the external surface of the outer casing 51. The engaging hooks 31 are formed on and protrude from the inner side of the cover 30 and engage the outer casing 51 at the corresponding elongated hole 511.

With reference to FIG. 3, when a user wants to fasten or loosen a bolt or a nut, the switching button 20 is pushed to move relative to the outer casing 51 by the user's thumb (if the user's right hand holds the outer casing 51) to communicate the communicating hole 11 of the selector valve 10 with the forward passageway or the reverse passageway of the cylinder 52. When the user presses a trigger of the pneumatic tool 50, the compressed air will flow into the cylinder 52 via the communicating hole 11, the forward passageway or the reverse passageway of the cylinder 52 to enable the pneumatic tool 50 to fasten or loosen a bolt or a nut.

Figure 4:
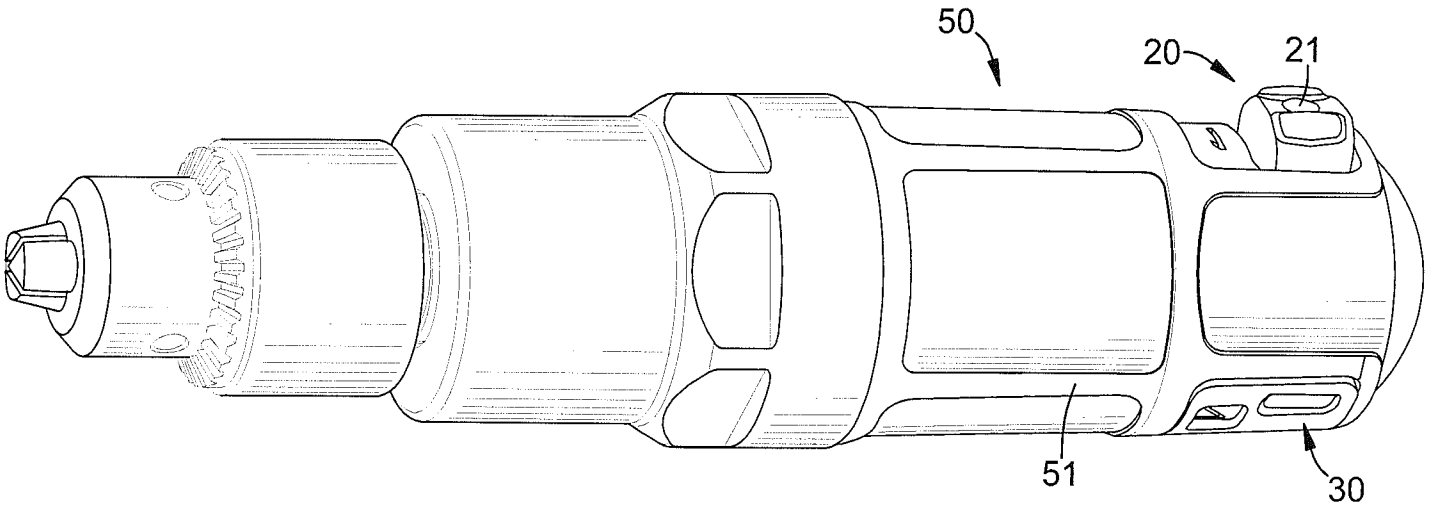
FIG. 4 is a top view of the pneumatic tool in FIG. 1.
Figure 5:
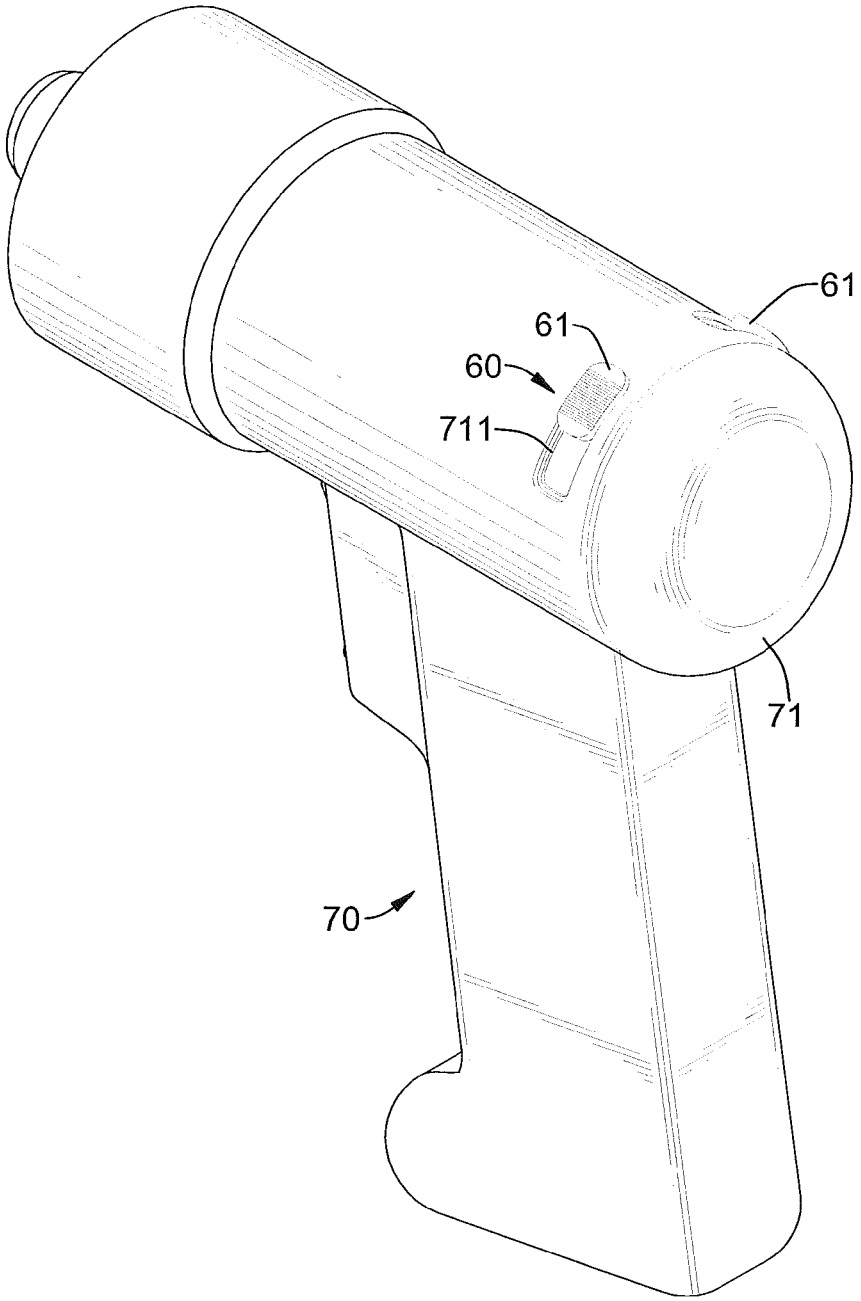
FIG.5 PRIOR ART
FIG. 5 is a perspective view of a pneumatic tool in accordance with the prior art.
Figure 6:
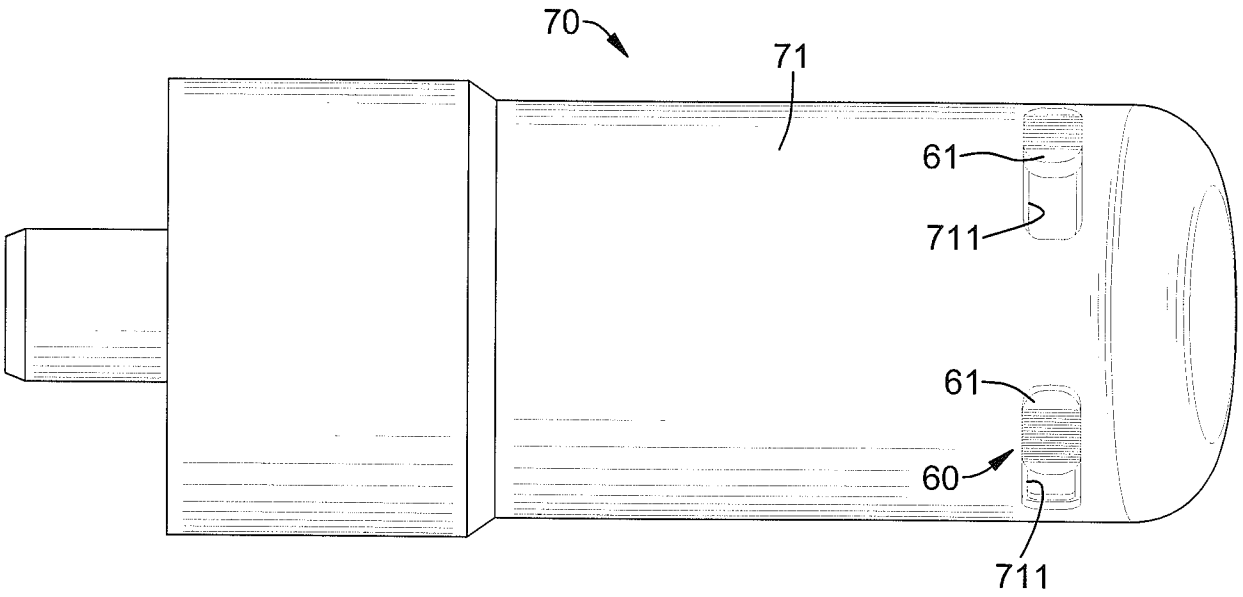
FIG.6 PRIOR ART
FIG. 6 is an operational top view of the pneumatic tool in FIG. 5.

With further reference to FIGS. 2 and 4, if the user's left hand holds the outer casing 51 in use, the switching button 20 and the cover 30 can be respectively detached from the corresponding block 12 and the outer casing 51 and respectively separated from the elongated holes 511. Then, the cover 30 and the switching button 20 are exchanged to enable the switching button 20 to connect with the other connecting block 12 and to enable the cover 30 to cover the other elongated hole 511 that is opposite to the switching button 20. Consequently, the switching button 20 can be movably mounted on the outer casing 51 above the user's left hand thumb to control the flow direction of the compressed air.

The user can change and adjust the position of the switching button 20 relative to the outer casing 51 according to the user's needs easily and conveniently by separating the switching button 20 and the cover 30 respectively from the corresponding connecting block 12 and the outer casing 51 and assembling the switching button 20 and the cover 30 respectively with the other connecting block 12 and the outer casing 51. In addition, the cover 30 is mounted on the outer casing 51 to cover the corresponding connecting block 12 in the outer casing 51. This can prevent the corresponding connecting block 12 from hitting the user's fingers when the switching button 20 is moved relative to the outer casing 51.

Even though numerous characteristics and advantages of the present invention have been set forth in the foregoing description, together with details of the structure and features of the utility model, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A pneumatic tool comprising:
an outer casing having:
a rear end;
an external surface having a shape; and
two elongated holes formed through the external surface of the outer casing near the rear end of the outer casing, facing and communicating to each other;
a selector valve rotatably mounted in the outer casing and having:
a rear side;
a middle segment;
an external surface;
a communicating hole obliquely formed through the rear side of the selector valve; and
two connecting blocks axially formed on and protruding from the external surface of the selector valve at the middle segment, aligning with each other and respectively facing and spaced radially inwardly from the two elongated holes of the outer casing, with each connecting block having an external surface;
a switching button detachably connected to one of the two connecting blocks of the selector valve inside of the outer casing and extending out of only one of the two elongated holes of the outer casing, wherein the switching button has:
an inner side mounted in the outer casing via the corresponding elongated hole and abutting with the corresponding connecting block;
an outer side extending out of the external surface of the outer casing via the corresponding elongated hole; and
two limiting blocks formed on and protruding from the inner side of the switching button at an interval and abutting with on opposite sides of the external surface of the corresponding connecting block to enable the switching button to steady connect with the selector valve; and
a cover detachably connected to the outer casing to close another of the two elongated holes that is opposite to the switching button and having a shape corresponding to the shape of the external surface of the outer casing.

2. The pneumatic tool as claimed in claim 1, wherein:
each one of the two connecting blocks has:
a center; and
a connecting hole formed in the center of the connecting block; and
the switching button has:
a through hole formed through the inner side and the outer side of the switching button located intermediate the two limiting blocks at the inner side of the switching button and aligning with the connecting hole of the corresponding block; and
a fixing element mounted through the through hole from the outer side to the inner side of the switching button and securely connected to the connecting hole of the corresponding connecting block to enable the switching button to connect with the selector valve at the external surface of the outer casing.

3. The pneumatic tool as claimed in claim 2, wherein the cover has:
an inner side; and
two engaging hooks formed on and protruding from the inner side of the cover and engaging the outer casing at the corresponding elongated hole.

4. The pneumatic tool as claimed in claim 2, wherein the connecting hole of each one of the two connecting blocks is a thread hole.

5. The pneumatic tool as claimed in claim 2, wherein the cover has:
an inner side; and two engaging hooks formed on and protruding from the inner side of the cover and engaging the outer casing at the corresponding elongated hole.

6. The pneumatic tool as claimed in claim 5, wherein the connecting hole of each one of the two connecting blocks is a thread hole.

7. The pneumatic tool as claimed in claim 1, wherein the cover has:

an inner side; and two engaging hooks formed on and protruding from the inner side of the cover and engaging the outer casing at the corresponding elongated hole.

8. The pneumatic tool as claimed in claim 7, wherein the connecting hole of each one of the two connecting blocks is a thread hole.

* * * * *